US005950461A

United States Patent [19]

Tsai

[11] Patent Number: 5,950,461

[45] Date of Patent: Sep. 14, 1999

[54] LOCK MECHANISM STRUCTURE

[76] Inventor: Ching-Tien Tsai, No. 3, Lane 28, Hsi-Shu Rd., Tainan, Taiwan

[21] Appl. No.: 09/167,737

[22] Filed: Oct. 7, 1998

[51] Int. Cl.[6] ..... E05B 67/24

[52] U.S. Cl. ..... 70/38 A; 70/39; 70/379 R; 70/380

[58] Field of Search ..... 70/38 A, 39, 49, 70/379 R, 379 A, 380

[56] References Cited

U.S. PATENT DOCUMENTS

| | | | |
|---|---|---|---|
| 652,337 | 6/1900 | Taylor | 70/38 A |
| 1,461,725 | 7/1923 | Cooper | 70/39 |
| 1,512,590 | 10/1924 | Freysinger | 70/39 |
| 1,525,815 | 2/1925 | Lawrence | 70/380 |
| 1,566,473 | 12/1925 | Gibson | 70/38 A |
| 3,008,318 | 11/1961 | Gutman | 70/38 A |
| 4,098,100 | 7/1978 | Wah | 70/379 R X |
| 4,345,447 | 8/1982 | Keung et al. | 70/38 A |
| 5,640,861 | 6/1997 | Chen | 70/39 X |

*Primary Examiner*—Lloyd A. Gall
*Attorney, Agent, or Firm*—Rosenberg, Klein & Bilker

[57] ABSTRACT

A lock mechanism structure includes a pair of latches with one end of each latch positioned against a spring and the other end of which are engaged with a rod. A block has a spring urging the block outwardly which in turn urges the latches outwardly to extend into a recess, whereas the other end of the block has a slope surface engaging with a corresponding slanting surface on a bulge extending upward from a rotating plate of a lock core, thus, when opening the lock, the lock core rotates to bring the bulge to push the block upwardly, whereas the other end of the block descends to urge the spring to retract, this allows the latch to detach from the recess and the lock is in a released status.

3 Claims, 8 Drawing Sheets

(PRIOR.ART)

(PRIOR.ART)

LOCK MECHANISM STRUCTURE

FIELD OF THE INVENTION

This invention relates to a lock mechanism structure and more particularly to a lock which includes a latch controlled by a block to insure the latch in a secured position.

BACKGROUND OF THE INVENTION

The conventional motorcycle lock has a very weak structure which may be broken easily, further bicycles have also no effective lock to protect bicycles from being stolen. Various locks have been developed for this reason, one of the kind is a U-shaped lock, as shown in FIG. 6 which includes a lock core 94 mounted at the center portion of a lock seat 91 to link two latches 93 at respective sides of the lock seat 91. The lock seat 91 is mounted in a lock barrel 92. Both of the lock seat 91 and the lock barrel 92 have a hole 911 and 921 at the center bottom portion and two holes 912 and 922 at respective ends for a pair of lock bars 95 to seat therein. The lock seat 91 also has a slot 913 for a pair of latches 93 to seat therein. Whereas the corresponding ends of the latches 93 are formed with a blind hole 931 to receive a spring 932 and a pin 933 therein, respectively. Each latch 93 has also formed with a recess 934 for a knob 941 of the lock core 94 to rest therein.

Upon studying the relation between the latch which when in a locked status, as shown in FIGS. 7 and 8, the two latches 93 are controlled merely by the spring 932 urging the latch 93 to insert into a recess 951 of the lock bar 95 to constrain movement of the lock bar 95. However, the recess 934 is to receive the knob 941 of the lock core 94 to seat therein, there is an extra space left which allows the latch 93 to move rearward, and owing to the spring 932 is not a fixed status, when the spring 932 is urged rearward, the latch 93 retreats from the lock bar 95 which means that by plunging the lock from outside, a reflection force will force the latch 93 to retreat from the recess 951 thus, the lock bar 95 is free for removal from the lock barrel 92.

SUMMARY OF THE INVENTION

This invention is relative to a lock mechanism structure including a pair of latches with one end of each latch positioned against a spring and the other end of which are engaged with a block. The block has a spring urging the latch outwardly which in turn urges the latches outwardly to extend into a recess, whereas the other end of the latch has a slope surface engaging with a corresponding slanting surface on a bulge of a protuberance extending upward from a rotating plate of a lock core, thus, when opening the lock, the lock core rotates to bring the bulge to push the block upwardly, whereas the other end of the block is descent to urge the spring to retract, this allows the latch to detach from the recess and the lock is in a released status.

It is the primary object of the present invention to provide a lock mechanism structure which is safe and secure from being illegal breaking through.

It is another object of the present invention to provide a lock mechanism structure which is easy to operate and simple in structure.

DETAILED DESCRIPTION OF THE DRAWINGS

Figure 1:
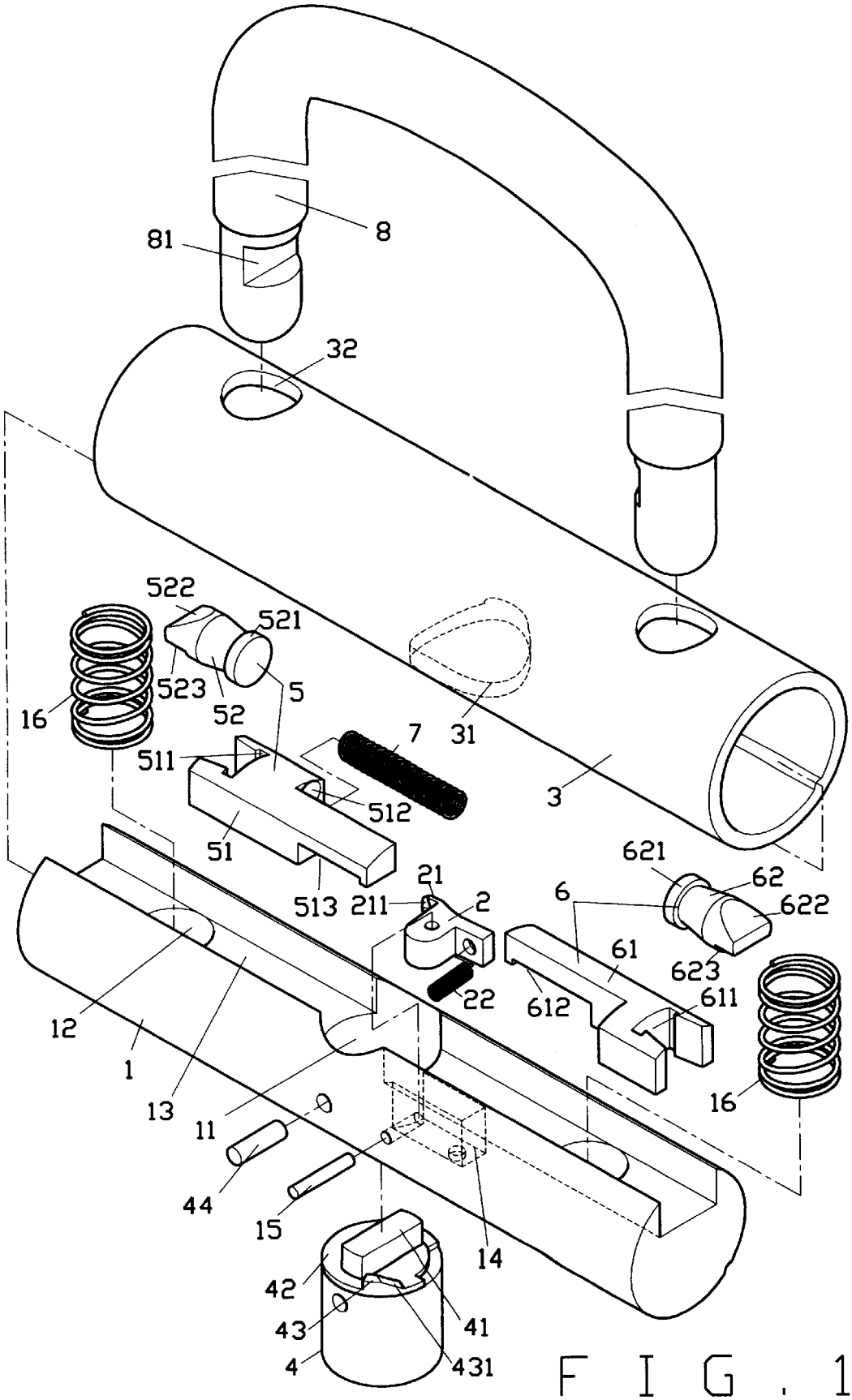
FIG. 1 is an exploded view of the present invention.
Figure 2:
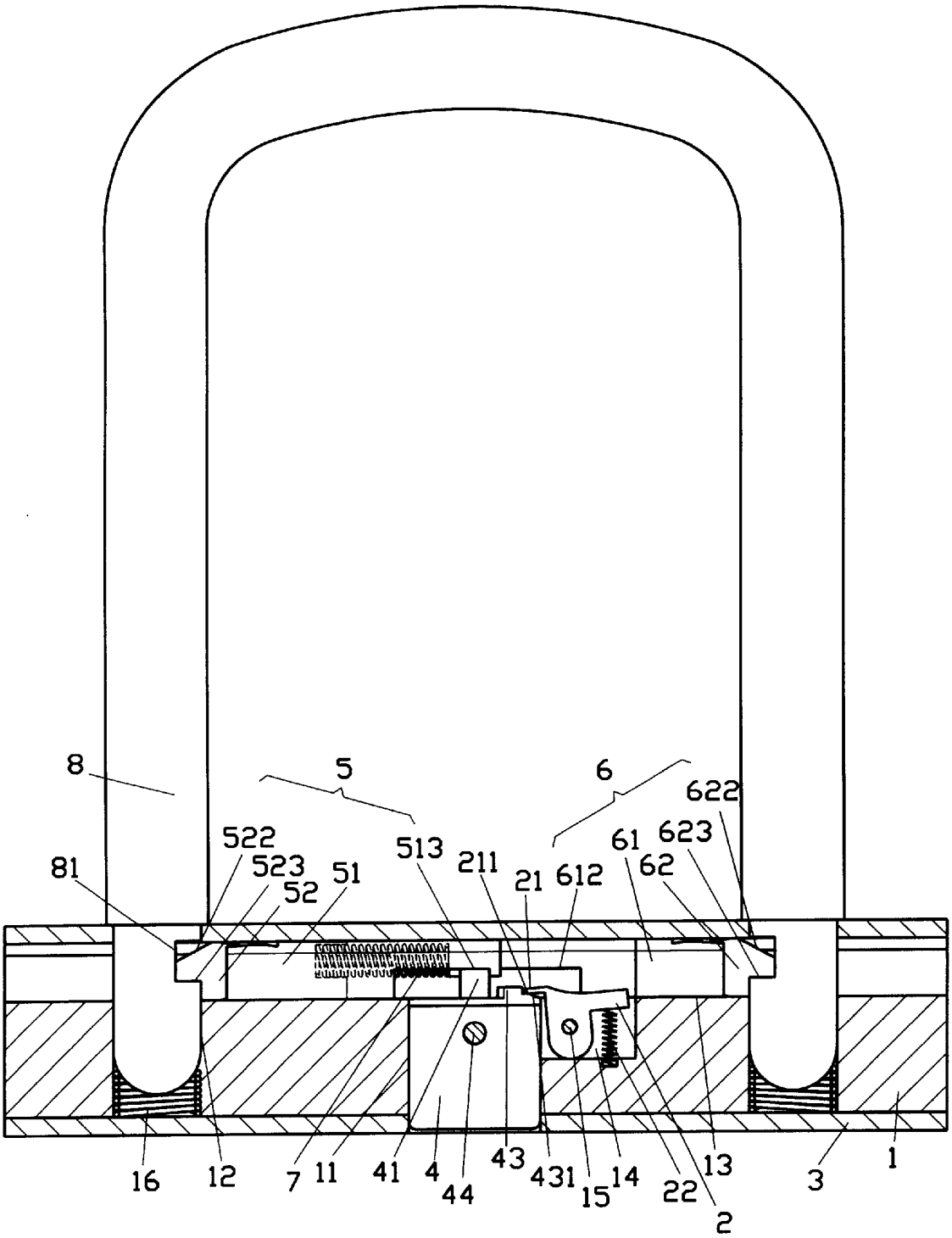
FIG. 2 is a side section view of FIG. 1, showing a locked status.
Figure 3:
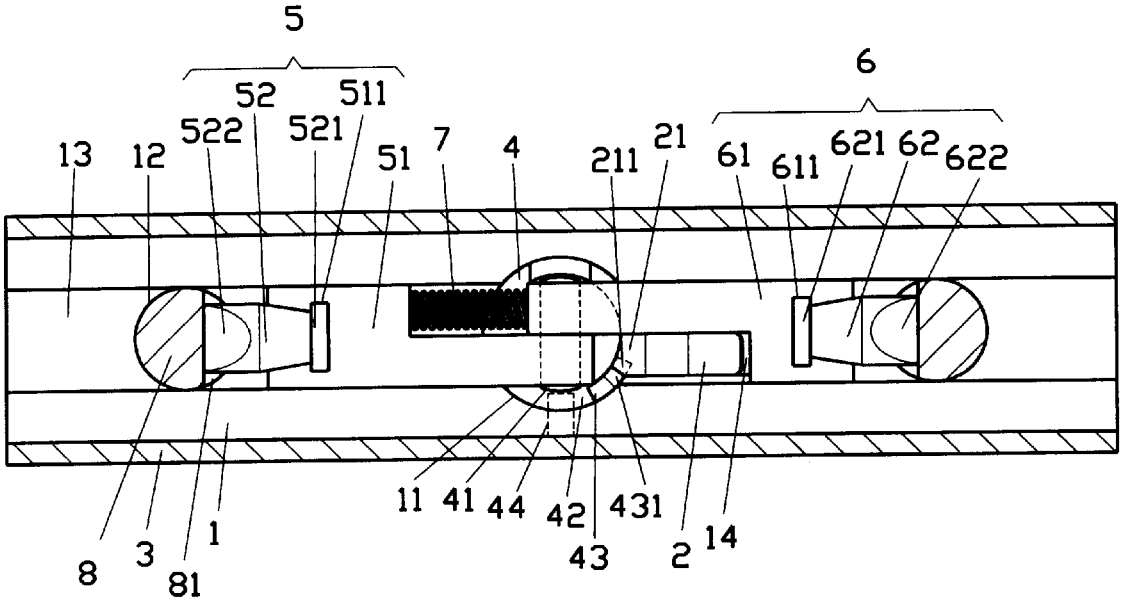
FIG. 3 is a side section view of the lock barrel of FIG. 2.

Referring to FIGS. 1, 2 and 3, the present invention includes a lock seat 1, a block 2, a lock barrel 3, a lock core 4, two latches 5 and 6, a spring 7 and a lock rod 8.

The lock seat 1 is a cylindrical body having a lock hole 11 axially extending at the center portion and two through holes 12 at respective sides thereof adapted to receive a pair of springs 16 therein, a ditch 13 extending longitudinally along the lock seat 1 intersects with the lock hole 11 having a recess 14 at connecting area of the lock hole 11 to receive the block 2 therein and secured by a pin 15 thereat.

The block 2 seats in the recess 14 of the lock seat 1 level with one end facing the lock hole 11 extending a branch 21 having a slanting surface 211 at its bottom end, the other end of the block 2 has a spring 22 extending outward and against the inner bottom surface of the recess 14.

The lock barrel 3 is a hollow cylinder, has an inner diameter slightly larger than that of the outer diameter of the lock seat 1, the lock barrel 3 has two openings at its respective ends, one lock hole 31 and a pair of through holes 32 are corresponding to the lock hole 11 and the through holes 12 of the lock seat 1.

The lock core 4 comprises a protuberance 41 connected with a rotating plate 42 which includes a bulge 43 having a slanting surface 431 at one end thereof, by inserting through and seating in the lock hole 11 and secured by a pin 44 thereat. The slanting surface 211 of the branch 21 engages with the slanting surface 431 of the bulge 43 which places the other end of the block 2 to extend into the bottom of the ditch 13.

The latches 5 and 6 are linked by a pair of linkages 51 and 61 and a pair of engaging members 52 and 62, respectively. The linkages 51 and 61 are formed with notches 511 and 611 which engage with bulge portions 521 and 621 extending from the engaging member 52 and 62 to form a linking mechanism and seating in the ditch 13. The linkage 51 has a blind hole 512 to receive a spring 7 therein to urge the linkage 61, each of the linkages 51 and 61 comprises a recess 513 and 612 to receive the protuberance 41 therein. Whereas the engaging members 52 and 62 are made of metal rod formed with slanting surfaces 522 and 622 and flat bottoms 523 and 623 opposing the bulge portions 521 and 621.

The lock rod 8 is shaped like an English letter U having a pair of recesses 81 at respective ends.

To operate the present invention, as shown in FIGS. 2 and 3, the engaging members 52 and 62 of the latches 5 and 6 are inserting into the recesses 81 of the lock rod 8 to restraint the lock rod 8 from being pulled away. The character is that the slanting surface 211 of the branch 21 of the block 2 rides upon the slanting surface 431 of the bulge 43 of the rotating plate 42 on the lock core 4, whereas the other end of the block 2 extends into the ditch 13, thus when the latch 6 is moved to retreat rearward and the linkage 61 abuts the block 2, the engaging member 62 of the latch 6 is still extending in the recess 81 of the lock rod 8 which stops the lock rod 8 from being detached.

Figure 4:
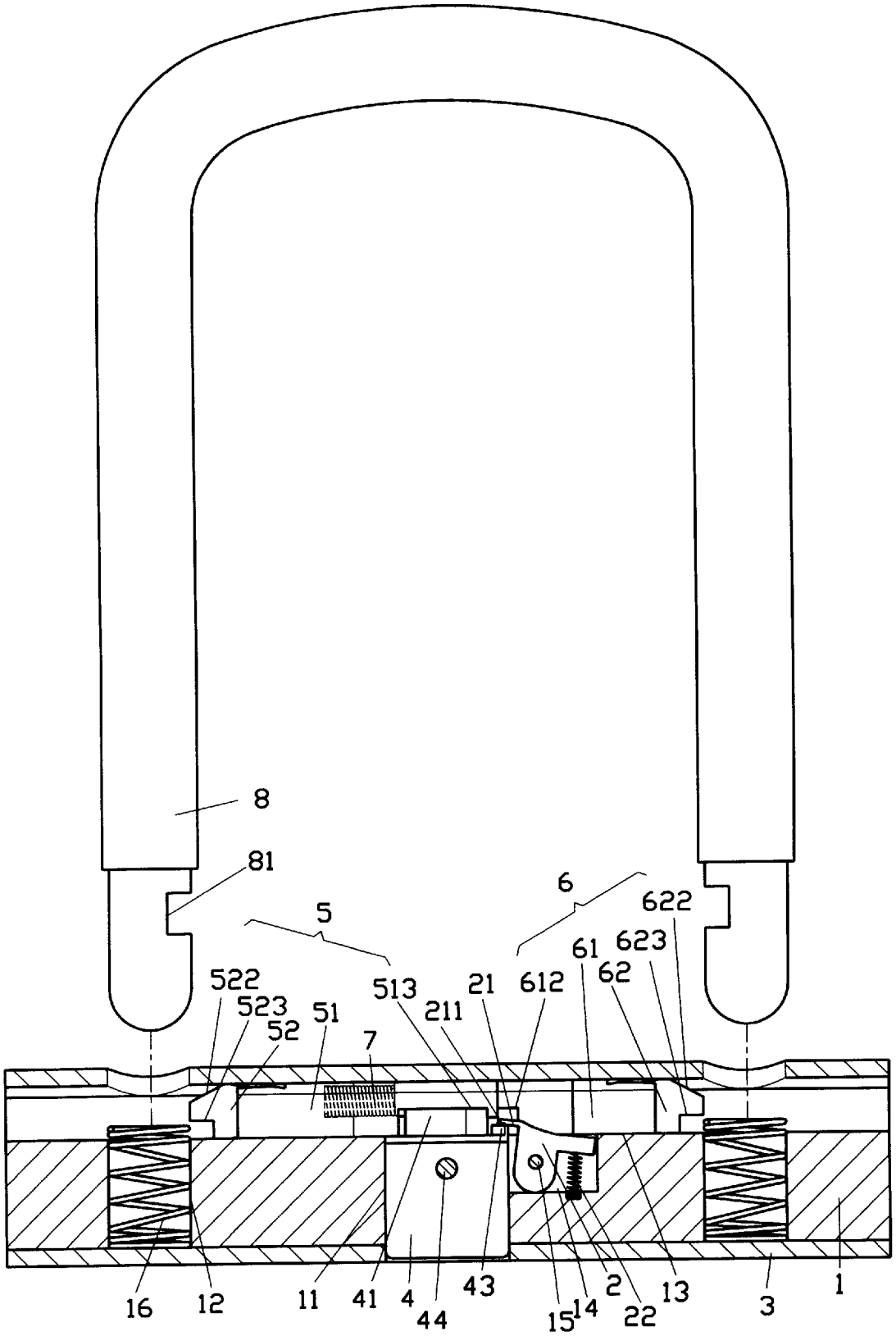
FIG. 4 is a side section view of FIG. 1, showing an unlocked status.
Figure 5:
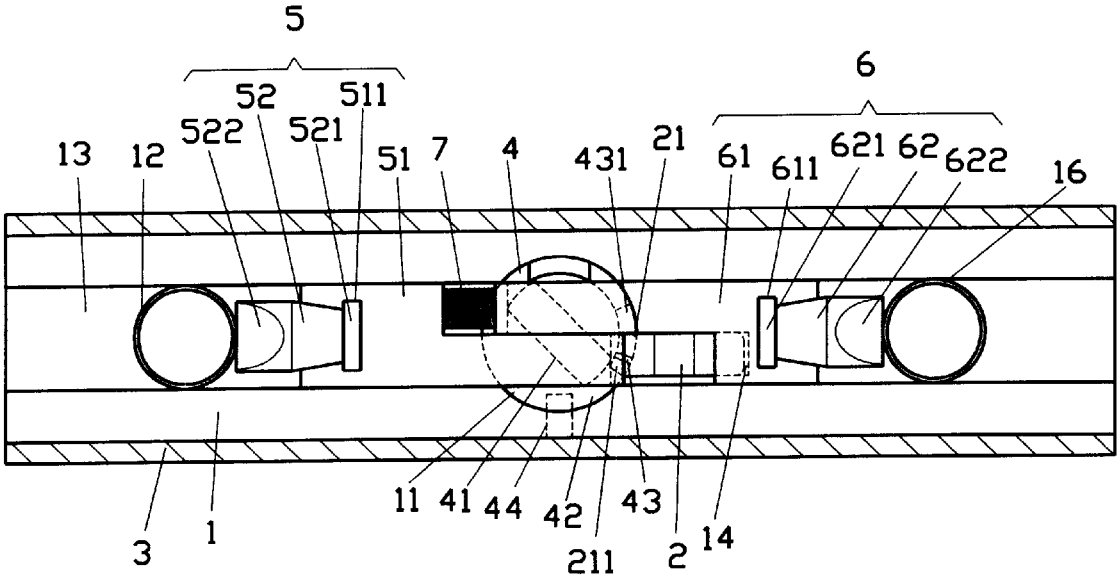
FIG. 5 is a side section view of the lock barrel of FIG. 4.
Figure 6:
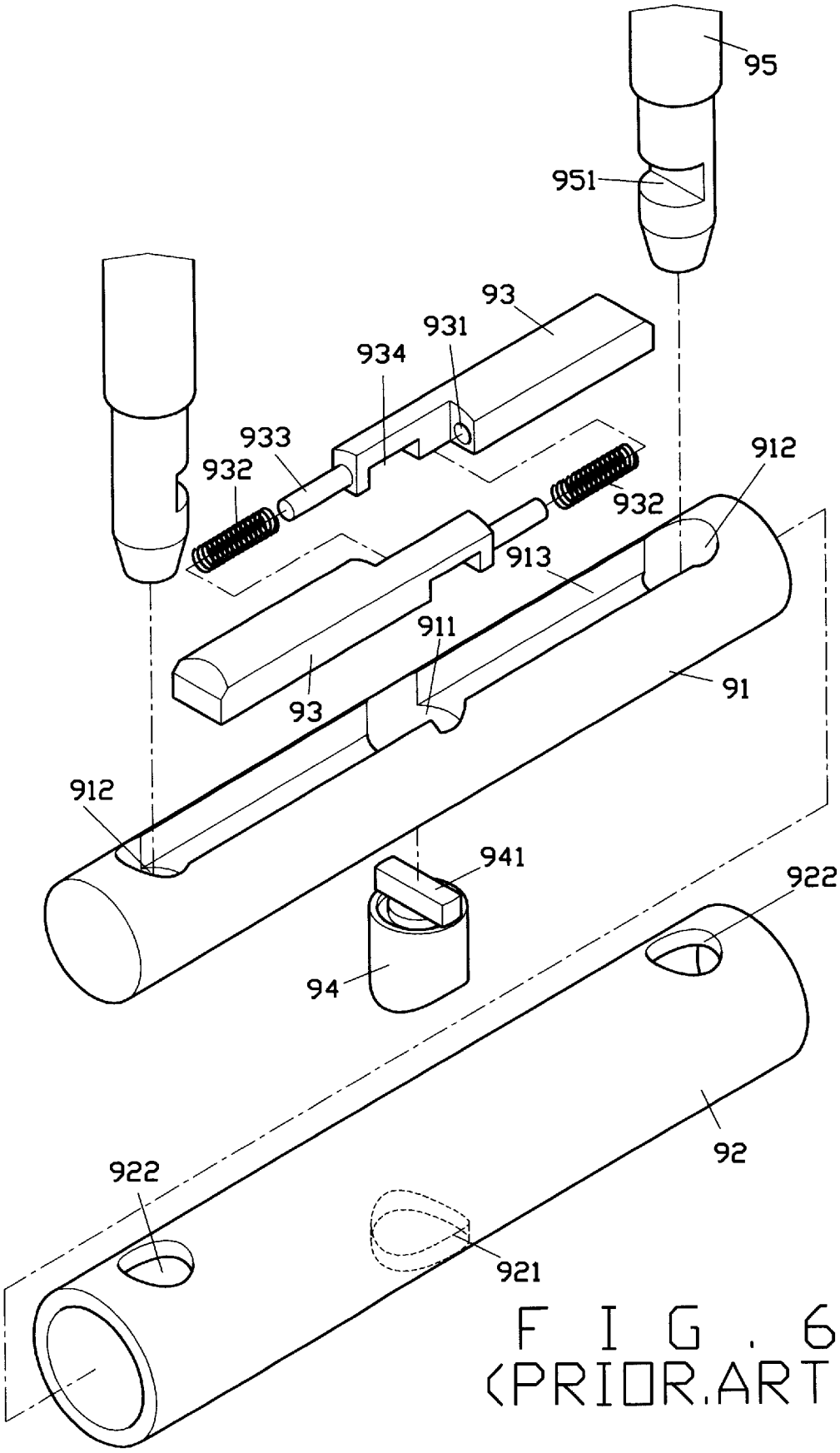
FIG. 6 (PRIOR ART)
FIG. 6 is an exploded view of a conventional art.
Figure 7:
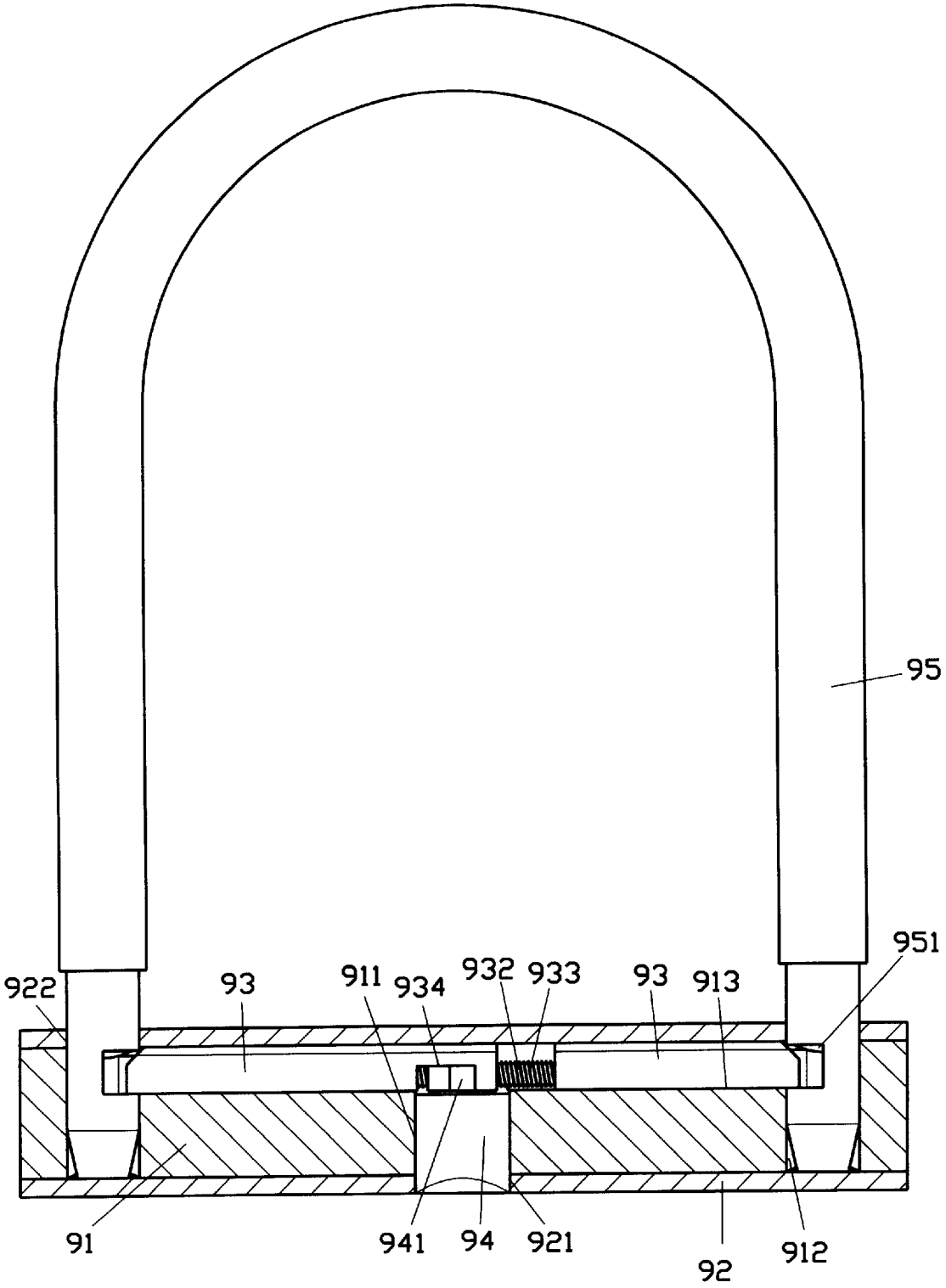
FIG. 7 is a side section view of FIG. 6, showing a locked status.
Figure 8:
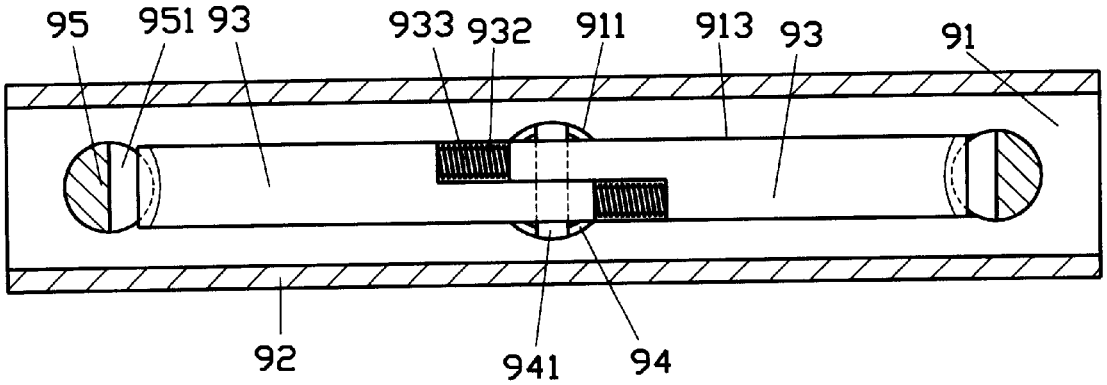
FIG. 8 is a side section view of the lock barrel of FIG. 8.

However, to open the lock, as shown in FIGS. 4 and 5, insert a legal key into the lock core 4 and rotate the protuberance 41 and the rotating plate 42, whereas the two ends of the protuberance 41 will push the linkages 51 and 61 of the latches 5 and 6 to move towards different directions and the branch 21 of the block 2 rises so that the other end of the block descends continuing movement of the linkages 51 and 61 will bring the engaging members 52 and 62 to detach from the recesses 81 of the lock rod 8.

I claim:

1. A lock mechanism structure comprising a lock seat, a block, a lock barrel, a lock core, two latches and a lock rod, wherein said lock seat having a lock hole axially extending at a center portion and two through holes at respective sides thereof, a ditch being formed in between said through holes for seating latches therein, one of said latches having an end to seat a spring thereat urging the other latch so that said two latches have their outermost end inserting into said through holes of said lock seat, said latches being formed with a recess at a bottom portion facing said lock core, such that said lock core is seated in said lock hole with a protuberance of a rotating plate extending into said recesses, said lock barrel having also a lock hole and two holes corresponding to said lock hole and said through holes of said lock seat, and the improvements comprising, said lock seat having a recess adjacent its lock hole to receive said block thereat wherein a branch being formed on said block at a side facing said lock hole of said lock seat whereas the other end of the block being urged by a spring to extend outward into said ditch and engaging with one end of a latch thus restraining movement of said latch said rotating plate of said lock core being formed with a bulge which rotates when rotating a key within said lock core which leads said bulge to rotate and push said branch which brings the other end of said block to descend away from engagement with said latch.

2. The lock mechanism structure as recited in claim 1, wherein said branch of said block being formed with a slanting surface engaging with a slanting surface of said bulge of said rotating plate.

3. The lock mechanism structure, as recited in claim 1, wherein said two latches being formed and linked with a linkage and an engaging member, respectively, said linkage and said engaging member being formed with a notch and a bulge portion which are interconnected with each other, said engaging member is made of metal rod being formed with a slanting surface and a flat bottom.

* * * * *